United States Patent [19]

Armstrong et al.

[11] 4,428,832

[45] Jan. 31, 1984

[54] SCREENING APPARATUS

[75] Inventors: Michael P. Armstrong, Etwall; Rodney W. O'Brian; Stanley Gilliver, both of Burton-on-Trent, all of England

[73] Assignee: Coal Industry (Patents) Limited, London, England

[21] Appl. No.: 322,875

[22] Filed: Nov. 19, 1981

[30] Foreign Application Priority Data

Dec. 5, 1980 [GB] United Kingdom ..... 8039087

[51] Int. Cl.[3] ..... B07B 1/08

[52] U.S. Cl. ..... 209/350

[58] Field of Search ..... 209/350, 148, 139 A, 209/359

[56] References Cited

U.S. PATENT DOCUMENTS

| | | | |
|---|---|---|---|
| 91,549 | 6/1869 | Lewis | 209/350 |
| 1,517,509 | 12/1924 | Hokanson | 209/148 |
| 1,783,357 | 12/1930 | Cook | 209/139 A |
| 1,996,190 | 4/1935 | Buck | 209/350 |
| 2,466,309 | 4/1949 | Gannon et al. | 209/350 |
| 2,910,180 | 10/1959 | Parks | 209/395 |
| 3,247,966 | 4/1966 | Harmon, Jr. | 209/395 |
| 4,220,526 | 9/1980 | Armstrong et al. | 209/350 |

FOREIGN PATENT DOCUMENTS

| | | | |
|---|---|---|---|
| 440697 | 3/1925 | Fed. Rep. of Germany | 209/350 |
| 1307290 | 1/1973 | United Kingdom . | |
| 2005157 | 4/1979 | United Kingdom . | |

OTHER PUBLICATIONS

Webster's Seventh New Collegiate Dictionary, Cpr. 1965, p. 705, Copy with Examiner.

*Primary Examiner*—Tim R. Miles

*Attorney, Agent, or Firm*—Stevens, Davis, Miller & Mosher

[57] ABSTRACT

The sizing screen comprises a plurality of rotatable screening decks mounted co-axially one below the other. The uppermost screening deck is rotated at a slower speed than the relative fast revolving lowermost screen deck.

5 Claims, 10 Drawing Figures

SCREENING APPARATUS

This invention relates to sizing screens for particulate material of different sizes.

In particular, although not exclusively, the present invention relates to sizing screens of the kind described and claimed in our prior British patent specification Ser. No. 1,307,290 (U.S. Pat. No. 3,779,381). Claim 1 of the prior specification defines a sizing screen comprising a circular screen surface consisting of a plurality of elongated members projecting from a hub and mounted for rotation about a generally vertical axis, drive means for rotating the surface, means for feeding material on to the surface, first collection means positioned adjacent to the outer periphery of the surface for collecting oversize material, and second collection means positioned below the surface for collecting undersize material. The patent specification disclosed a screen comprising a plurality of screening decks each consisting of a plurality of elongate members arranged to define a circular screen surface and all rotated at the same relatively high speed. It was proposed that different size fractions could be obtained by having the elongate members on the different decks arranged at different spacings. Unfortunately, as all the decks are rotated at the same relatively high speed the screen tended only to be suitable for treating relatively small material.

A modified sizing screen disclosed in the assignee's prior British patent specification Ser. No. 2,005,157 (U.S. Pat. No. 4,220,526) comprises feeder means for causing an even distribution of material on to a single screen deck, rotating at a relatively high speed, the feeder means comprising a fixed generally spirally shaped plough arranged to urge material over the edge of a generally circular table rotating at a relatively slow speed.

An object of the present invention is to provide an improved sizing screen tending to enable relatively large size material to be treated.

According to the present invention a sizing screen for particulate material comprises a plurality of rotatable screening decks each having a generally circular outer periphery, the decks being mounted co-axially one below the other, each deck comprising a plurality of radially extending elongate members, drive means for rotating the decks such that, in use, at least some of the decks are rotated at different speeds, means for feeding material on to the screening surface of the uppermost deck, and collection means for collecting material discharging over the peripheries of the screening decks and material passing through the lowermost screening deck.

Preferably, the screen comprises two screening decks and the collection means comprises first collection means positioned adjacent to the outer peripheries of the decks for collecting material discharging over the peripheries of the screening decks and second collection means arrangeable below the lowermost deck for collecting undersize material passing through the lowermost screening deck.

Preferably, the uppermost deck is rotated at a slower speed than the lowermost deck.

Conveniently, the means for feeding material on to the screening surface of the uppermost deck comprises a rotating plate arranged substantially co-axially with the screening decks.

Advantageously, the uppermost deck is mounted for rotation with the rotating plate.

Preferably, the uppermost deck is mounted on to the rotating plate.

Preferably, the elongate members of the uppermost deck are downwardly inclined in a radially outward direction.

Alternatively, the uppermost deck is rotated by the drive means independantly of the means for feeding material on to the screening surface of the uppermost deck.

Preferably, the elongate members of the uppermost deck are mounted on a hub rotated by the drive means.

The first collection means may be adapted to separately collect material discharging over the peripheries of the screening decks.

By way of example only, two embodiments of the present invention now will be described with reference to the accompanying drawings, in which.

Figure 1:
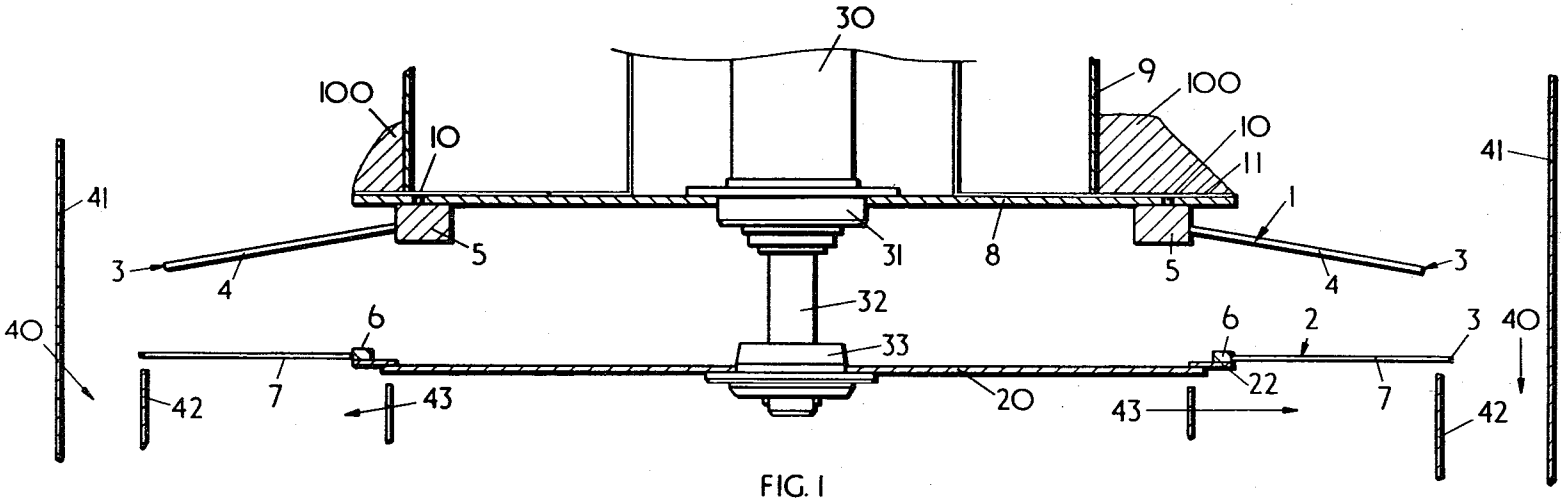
FIG. 1 is a diagrammatic, vertical cross-sectional view taken through a portion of a sizing screen constructed in accordance with a first embodiment of the present invention.
Figure 2:
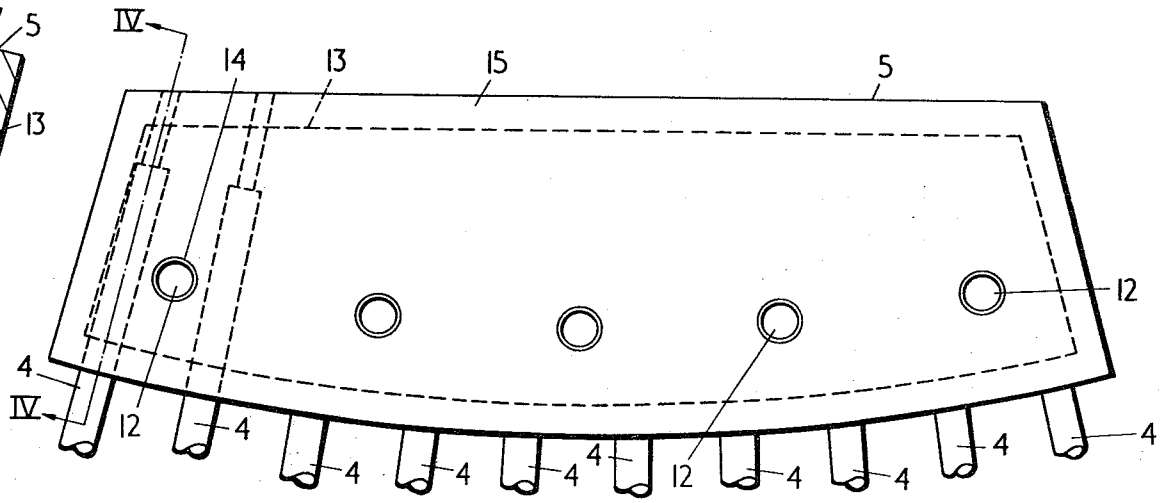
FIG. 2 is a plan of a detail of FIG. 1.
Figure 3:
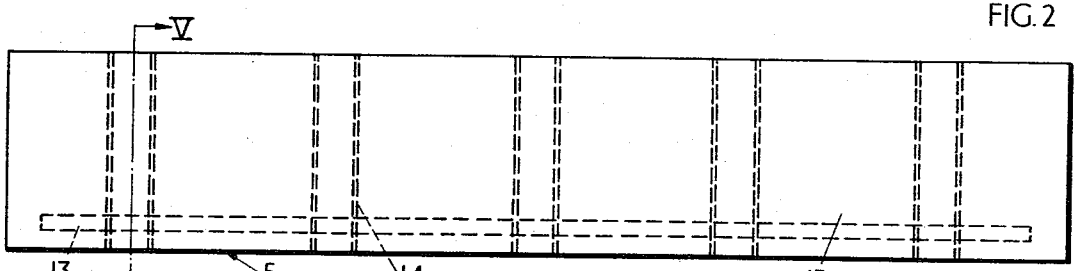
FIG. 3 is a side elevation of the detail of FIG. 2.
Figure 4:
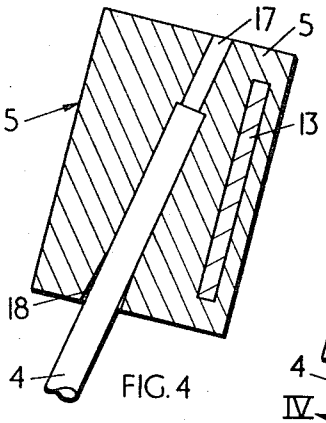
FIG. 4 is a section taken along line IV—IV of FIG. 2.
Figure 5:
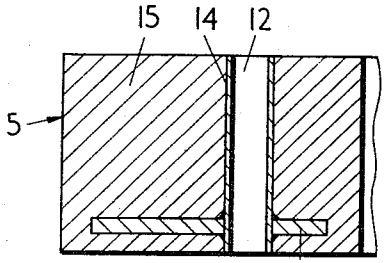
FIG. 5 is a section taken along line V—V of FIG. 3.

FIG. 1 shows the first embodiment of sizing screen to comprise an uppermost rotatable screening deck 1 and a lowermost rotatable screening deck 2 each having a generally circular outer periphery 3 and each comprising a plurality of radially outwardly extending members, rods, spokes or fingers 4 and 7 mounted in support blocks 5 and 6 as will be explained later in the specification. The screen decks substantially are mounted co-axially one below the other.

The sizing screen also comprises feeder means for feeding particulate material to be treated on to the screening surface of the uppermost deck 1, the feeder means comprising a generally horizontal rotatable plate 8 mounted co-axially with the screening decks 1 and 2 and a stationary plough 9 arranged to urge material 100 over the edge of the rotationg plate 8 and on to the screening surface of the uppermost deck. Details of the feeder means are disclosed in our prior British patent specification No. GB 2,005,157A.

As seen in FIG. 1 the support blocks 5 are mounted on to the underside of the rotatable plate 8 by bolts (not shown) engaged in bolt holes 10 formed in the rotating plate but not extending through a hard wearing lining plate 11. Details of one of the support blocks 5 are shown in FIGS. 2 to 5. Each block 5 is shown to provide a support bearing for a plurality of the radially outwardly extending members 4 and each block is provided with a plurality of bolt holes 12 for the previously mentioned bolts securing the blocks to the underside of the rotatable plate 8. The bolts holes 12 are constituted by tubes 14 which together with a rigid metal plate 13 constitutes the support skeleton for the block 5, the body 15 of the block being formed of a cast tough plastic material for example, polyurethane. A plurality of downwardly inclined stepped bores 17 formed in the body 15 each provide a mounting for one of the radially outwardly extending members 4, the relatively large diameter portion of each stepped bore 17 having a outwardly tapering section 18 faciltating entry of the associated elongate members 4 into the stepped bore and which produces a gradually tightening grip on the member 4 thereby avoiding a high stress concentration at the point of entry. The elongate members are retained in the stepped bores by the action of friction, each member being a tight fit in the associated stepped bore.

It will be appreciated that a plurality of the support blocks 5 are secured all around the underside peripherial margin of the rotatable plate such that the uppermost screening deck 1 defines an effectively continuous circular outer periphery 3.

Figure 7:
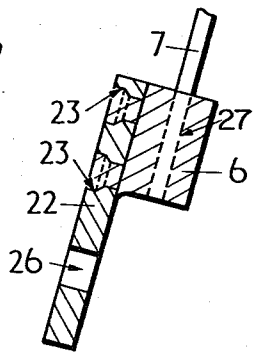
FIG. 7 is a section taken along line VII—VII of FIG. 6.
Figure 6:
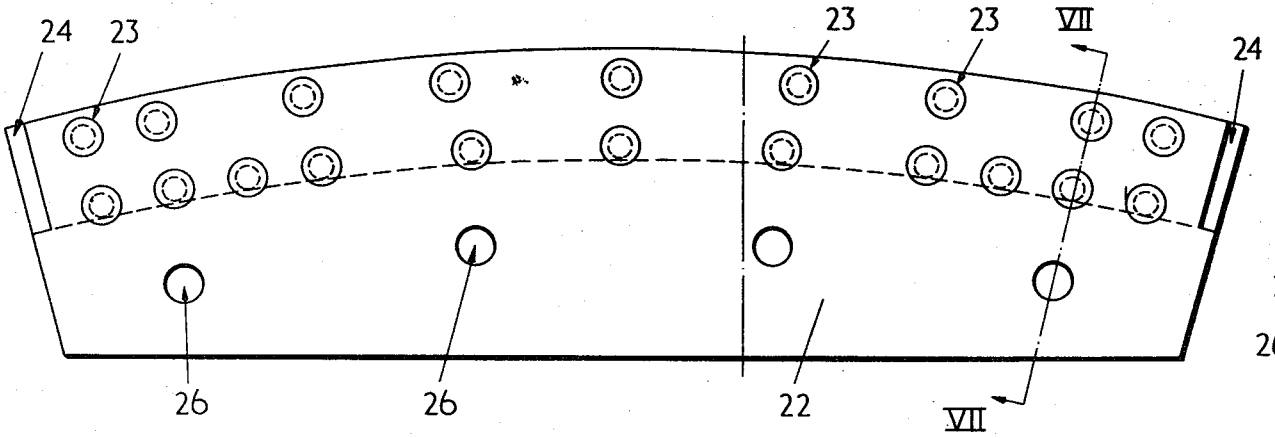
FIG. 6 is an inverted plan of a further detail of FIG. 1.

The lowermost screening deck 2 comprises a generally circular rotatable plate 20 mounted on a hub 33 and provided with stands 22 carrying the previously mentioned support blocks 6 for the elongate members 7. The blocks 6 which are shown in detail in FIGS. 6 and 7 are mounted on stands 22 and each supports a plurality of members 7. Each support block 6 is formed from a cast tough plastic material, for example, polyurethane which is moulded on to the metal stand plate 22, the plate being provided with fixing holes 26 for attachment to the circular plate 20. Counter bored holes 23 in the support plate allow the plastic material to enter the plate on moulding and provide a secure attachment. The plate 20 also has cut out portions 24 adjacent to its ends which are filled with plastic material on casting. Thus, each block 6 has end margins of relatively soft plastic material which on assembly of the screening deck can be cut away if necessary to assist assembly.

Fixing holes 27 are provided in the block 6 for accommodating the member 7, as with the holes 18 in the blocks 5 the holes 27 have tapered entry portions. As seen in FIG. 1 the member 7 generally extends horizontally from the support block.

Drive means for rotating the rotatable plate 8 together with the uppermost screen deck 1 at a relatively slow speed comprises a tubular vertical shaft 30 and hub 31. Separate drive means for rotating the lowermost screen deck 2 at a relatively fast speed comprise a generally vertical inner driven shaft 32 and hub 33. Thus, in operation the plate 8 of the feed means and the uppermost screen deck rotate at a relatively low speed, for example, ten to fifteen revolutions per minute and the lowermost screen deck rotates at a relatively high speed, for example fifty to eighty revolutions per minute.

The spacing of the elongate members 4 and 7 associated with the two screen decks 1 and 2 may be the same. Alternatively, the spacing of the elongate members associated with the uppermost deck may be greater than the spacing of the elongate members associated with the lowermost deck. As the uppermost screening surface is relatively slow moving the probability screening effect of the surface movement will be relatively small and the spacing of the elongate members substantially will be equal to the desired size of primary separation.

The sizing screen also comprises collection means for collecting the treated particulate material. In the embodiment shown in FIG. 1 the collection means comprises first collection means for collecting material retained on the uppermost screening deck 1 and on the lowermost screening deck 2, the material being retained on the screening decks until it is discharged over the periphery of the rotating decks into a common annular chute 40 formed between an outer generally cylindrical casing 41 and an inner generally cylindrical casing 42. The collection means also comprises a second collection means comprising a chute arrangement 43 mounted beneath the screening surface of the lowermost screen deck 2 for collecting undersize material.

In the screening operation untreated particulate material 100 fed on to the relatively slowly rotating plate 8 from a feed chute arrangement (not shown) is urged over the periphery of the plate by the action of the plough 9 and on to the relatively slowly rotating uppermost screen deck 1 where the relatively large oversize material flows down the downwardly inclined relatively slow moving screening surface defined by the radially outwardly extending members 4 towards the first collection means 40. The non-oversize fraction passes through the uppermost screen deck 1 on to the relatively fast revolving screen surface defined by the radially outwardly extending member 7 of the lowermost screen deck 2 which further sub-divides the material into an intermediate size material which flows under the action of centrifugal force over the periphery of the lowermost screen deck 2 towards the first collection means 40 and an undersize product which passes through the lowermost screening surface to be collected by the second collection means 43. In this embodiment the upper screening deck is acting as a relieving or scalping deck to limit the size of material being presented to the lower deck.

Thus, the sizing screen is capable of continuously handling untreated particulate material containing a fraction of relatively large size material which although being unsuitable for treatment on a relatively fast revolving screen deck can be treated on the relatively slow revolving uppermost screen deck 1. As the uppermost screening surface is moving at a relatively slow speed the amount of wear and damage caused by impact of the relatively large size fraction during screening tends to be limited to an acceptable level. As the uppermost screen deck 1 is rotating at the same relatively low speed as the feeder plate 8 impact of the material on the uppermost screening surface tends to be minimal.

Figure 8:
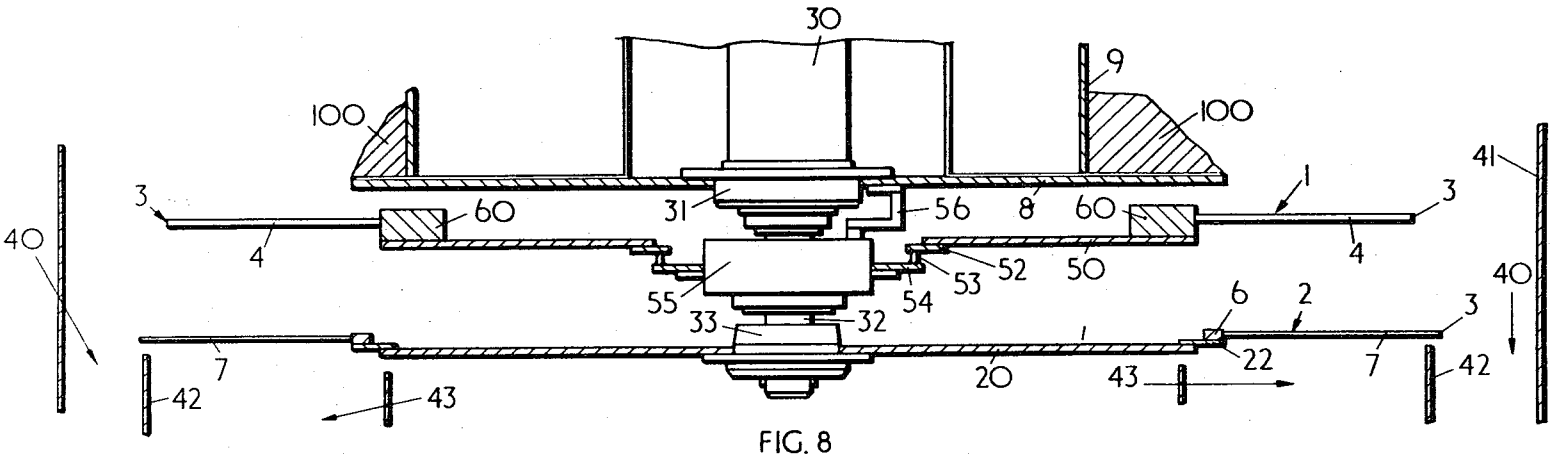
FIG. 8 is a diagrammatic, vertical cross-sectional view taken through a portion of a sizing screen constructed in accordance with a second embodiment of the present invention.

FIG. 8 shows a second embodiment of sizing screen constructed in accordance with the present invention, the same reference numerals have been used for similar items previously referred to in describing the first embodiment.

Figure 9:
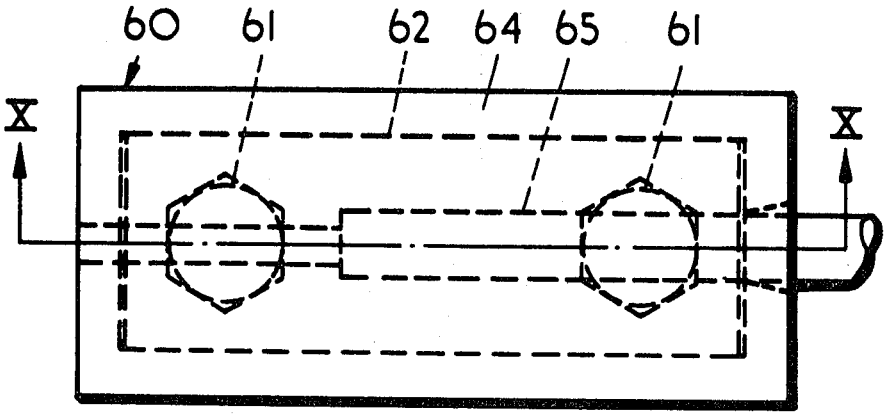
FIG. 9 is a plan of a detail of FIG. 8.
Figure 10:
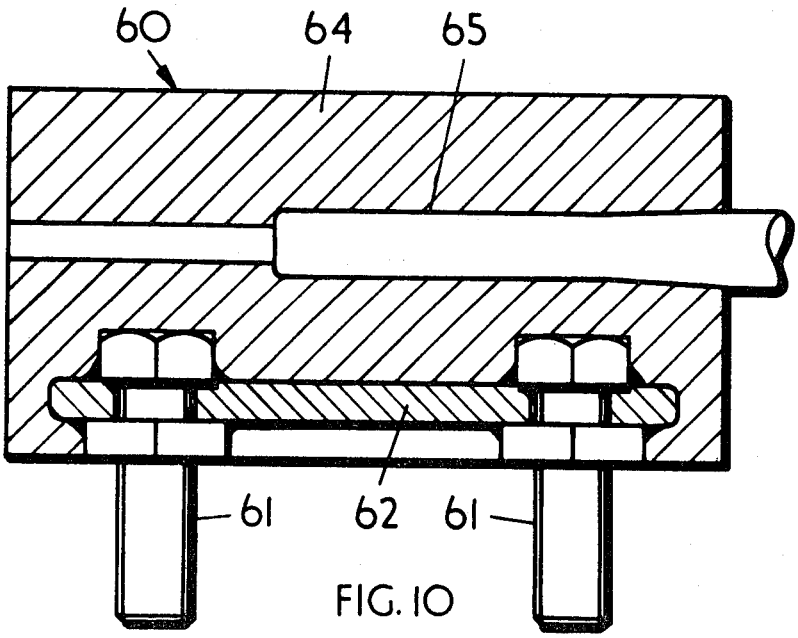
FIG. 10 is a section taken along line X—X of FIG. 9.

In the second embodiment, the support block 5 of the previously described embodiment are replaced by support block 60 each of which supports a single radially extending member 4. Details of the block 60 are shown in FIGS. 9 and 10.

The blocks 60 are mounted on a generally horizontal annular plate 50 by means of two studs 61, the plate 50 being provided with a pattern of fixing holes which allow the spacing of the blocks 60 to be varied. Each block 60 is formed from a cast tough plastic material 64, for example, polyurethane which is moulded on to a metal plate 62 to which the aforementioned studs 61 are secured. A stepped fixing hole 65 is provided in the block 60 for accommodating the member 4, as with the previously discussed fixing holes 18 and 27 the holes 65 have tapered entry portions. As seen in FIG. 8 the members 4 extend substantially horizontally. However, if the desired rotational speed of the screen deck 1 is insufficient for the resulting centrifugal force to cause the material to discharge over the periphery of the rotating screening deck, the members 4 can be downwardly inclined to assist radially outward passage of the material.

The plate 50 is mounted on a stand assembly 52, 53, 54 which is drivably connected to the drive shaft 32 by an epicyclic gearbox 55 one component of which is effectively anchored to the underside of the slower moving feed plate 8.

The drive arangement 32, 55 is arranged to rotate the uppermost screen deck at a relatively slow speed compared with the relatively high speed of the lowermost deck, the relatively slow speed of rotation of the uppermost screen deck being equal to or greater than the relatively slow speed of rotation of the rotating feeder plate 8.

The second embodiment has the advantage that the speed of rotation of the uppermost screen deck substantially is independant of the rotational speed of the feeder plate 8.

From the above description it will be seen that the present invention provides screening apparatus which has the advantages of the rotating screen and is capable of treating particulate material containing a fraction of relatively large size.

In other embodiments of the present invention, the first collection means is adapted to separately collect treated material discharging over the peripheries of the two screening decks 1 and 2.

In still further embodiments of the present invention the sizing screen comprises more than two screen decks, at least some of which are rotated at different speeds.

We claim:

1. A sizing screen for particulate material comprising:

a generally circular upper deck having a central plate and a plurality of first radially straight spoke members extending radially outwardly from the periphery of said plate and circumferentially spaced around said periphery, said first spoke members comprising metal rods secured to extend from the periphery of said central plate by means of at least one block of plastics material secured to one side of said plate;

means for delivering material to said upper deck and means for moving said material radially outwardly on said plate toward said spoke members;

a lower deck mounted co-axially below said upper deck and spaced vertically therefrom a distance so that material passing through said upper deck will be separately screened by the lower deck, said lower deck having a central plate and a plurality of second radially straight spoke members spaced circumferentially closer together than said first spoke members and in vertical alignment therewith;

means for rotating both said decks with the lower deck rotating a higher speed than the upper deck;

collection means for collecting treated material discharging over the periphery of the screening decks and material passing through the lower screening deck.

2. A screen as claimed in claim 1, in which the elongate members of the uppermost deck are downwardly inclined in a radially outward direction.

3. A screen as claimed in claim 1, in which the uppermost deck is rotated by the drive means independently of the means for feeding material onto the screening surface of the uppermost deck.

4. The screen of claim 1, in which the central plate has a hard wearing lining on its upper surface.

5. The screen of claim 1, in which the central plate has a hard wearing lining on its upper surface and said at least one block of plastics material is secured to said central plate by fastening means which do not extend through said lining.

* * * * *